United States Patent [19]

Kelly

[11] Patent Number: 5,045,673

[45] Date of Patent: Sep. 3, 1991

[54] PTC DEVICES AND THEIR COMPOSITION

[75] Inventor: Cornelius J. N. Kelly, Simsbury, Conn.

[73] Assignee: General Signal Corporation, Stamford, Conn.

[21] Appl. No.: 504,499

[22] Filed: Apr. 4, 1990

[51] Int. Cl.[5] ..... H05B 3/00

[52] U.S. Cl. ..... 219/553; 219/504; 219/505; 219/528; 219/548; 338/22 R; 338/214; 252/510; 252/511; 264/105

[58] Field of Search ..... 219/504, 505, 578, 548, 219/553; 338/22 R, 212, 214; 252/510, 511; 264/105

[56] References Cited

U.S. PATENT DOCUMENTS

| | | | |
|---|---|---|---|
| 3,861,029 | 1/1975 | Smith-Johannsen et al. | 29/611 |
| 4,277,673 | 7/1981 | Kelly | 219/528 |
| 4,327,480 | 1/1982 | Kelly | 29/611 |
| 4,348,584 | 9/1982 | Gale et al. | 219/505 |
| 4,367,168 | 1/1983 | Kelly | 252/511 |
| 4,459,473 | 7/1984 | Kamath | 219/553 |
| 4,591,700 | 5/1986 | Sopory | 219/505 |
| 4,629,869 | 12/1986 | Bronnvall | 219/505 |
| 4,866,253 | 9/1989 | Leder | 219/548 |

OTHER PUBLICATIONS

Narkis Article at pp. 1163–115, vol. 22, Journal of Applied Polymer Science, 1978.

Cabot Corporation Technical Report S-136 entitled "Carbon Blacks for Specialty Applications".

*Primary Examiner*—Bruce A. Reynolds
*Assistant Examiner*—Michael D. Switzer
*Attorney, Agent, or Firm*—Robert R. Hubbard

[57] ABSTRACT

PTC Devices and PTC compositions described herein comprise a blend of at least three carbon blacks as a particulate filler in a fluorinated polymer to achieve a substantial PTC effect and operability over a wide temperature range including temperatures prevailing in a steam environment. Two of the carbon blacks are selected to impart PTC effect to the composition. The third carbon black is selected to adjust the resistive properties of the composition into the range of commercial usage and to impart uniformity of the resistive properties within a given batch as well as from one batch of mix to the next.

14 Claims, 2 Drawing Sheets

PTC DEVICES AND THEIR COMPOSITION

This invention relates to novel and improved PTC devices and compositions useful therein. In particular, the novel PTC devices of this invention are operable over a wide temperature range including the problematic high temperature range for steam cleaning of process pipes and are characterized by high production yields.

BACKGROUND OF THE INVENTION

The PTC devices of this invention are useful, for example, in the form of self-regulating heater cable for process control, for example, viscosity maintenance in chemical plants, oil refineries, etc. They are also useful for freeze protection of pipes, valves, vessels and the like in such industrial applications as food processing plants, power stations, refineries, chemical plants, offshore platforms, steel mills and commercial buildings.

PTC (positive temperature coefficient) compositions and devices which exploit them are well known in the art. When a constant voltage is applied across the composition, the current and the resistance stay approximately constant so long as the PTC composition is at low temperature. When the PTC composition heats up, it reaches a "switching" temperature or temperature range where its resistance increases dramatically (a factor of six or more), and since the voltage is constant, current decreases. Accordingly, PTC devices act essentially as temperature self-regulating devices.

Self-regulating heater articles and/or cable have been available for many years. Typically, the cable article comprises a pair of spaced elongated electrodes or wires that are embedded in a semiconductive core material that exhibits a PTC characteristic. The core material composition comprises a crystalline polymer in which is dispersed a carbon black filler with a typical loading in the 12–20% range by weight of the total composition,.

The temperature up to which the heater article can be used (upper use temperature) is determined primarily by the type of polymer used in the PTC composition. In low temperature applications, the PTC composition polymer is typically polyethylene which has a use temperature up to 85° C. The industry has been capable of producing self-regulating heater articles with polyethylene based PTC compositions with a reasonable production yield. The carbon black filler in some cases is highly conductive, such as, Vulcan XC72 (U.S. Pat. No. 3,861,029) in other cases is highly resistive, such as Mogul L or Raven 1255 (U.S. Pat. Nos. 4,277,673, 4,327,480 and 4,367,168) and in still other cases is a blend of blacks (U.S. Pat. Nos. 4,277,673, 4,327,480 4,367,168 and the Narkis article at pages 1163–115-,volume 22, Journal of Applied Polymer Science, 1978). The carbon blacks, Vulcan XC72 and Mogul L, are available from Cabot Corporation, Waltham, Mass. and Raven 1255 is available from Cities Service Co. Typical production processes are described in U.S. Pat. No. 4,327,480 and in U.S. Pat. No. 4,866,253.

The process described in Patent No. 4,327,480 is particularly advantageous in that it is characterized by short anneal times that permit a continuous feed of the cable extrudate through an anneal oven. That is, annealing is performed while the cable extrudate is in transit. A significant advantage of this process is that the power rating of the cable product can be controlled as a function of (1) the anneal time or speed of the cable extrudate through the anneal oven, and (2) the temperature of the oven.

For self-regulating heater articles intended for high temperature applications, it has been customary for 10 years or so to use polymers with much higher melting points, such as fluoropolymers (for example, ethylene-tetrafluoroethylene copolymer, with a melting point of about 270° C., U.S. Pat. No. 4,591,700). Self-regulating heater articles using fluoropolymers have been plagued with production yield problems that result in higher production costs and market prices. Typically, these problems involve nonuniformity of article resistance made from (1) a single batch of core material and (2) different batches of the same mix. This has caused resort to screening tests in which a production run is tested at various points along the length for hot and cold spots. The screening test involves measuring temperatures at different locations along the cable length with voltage applied at either or both ends of the cable. The measured temperatures are correlated with power output as measured at each end of the cable. Cold spots of the cable are cut out and scrapped. This obviously increases the cost of production as well as market price of finished heater articles.

One prior art self-regulating heater cable intended for high temperature applications is similar to the cable described in U.S. Pat. No. 4,459,473 which employs two wires which are held in spaced apart relation by a spacer and a PTC heating strip helically wound about the wires. This product has been reported as having experienced arcing at the strip/wire contact points, particularly at higher voltages. The product is also expensive to make because of the operations required to implement the spaced wires, the PTC strip and the winding of the strip about the spaced wires.

BRIEF SUMMARY OF THE INVENTION

An object of this invention is to provide novel and improved PTC devices which are capable of operation at low temperatures as well as high temperatures and which can be produced with reasonable production yields.

Another object of the invention is to provide a novel and improved PTC composition which is suitable for use in heater articles, is capable of operating at low temperatures as well as high temperatures and can be produced with reasonable production yields.

Briefly, a PTC device in accordance with the present invention is embodied in an electrically conductive self-regulating heater article that is capable of operation over a wide temperature range up to the high temperatures encountered in steam environments. The article is comprised of at least two spaced elongated electrodes electrically interconnected by and embedded in a self-regulating semiconductive composition which exhibits PTC effect. The composition contains (a) a fluoropolymer having at least 20% crystallinity as determined by X-ray diffraction and (b) a particulate filler component which is dispersed in the polymer and which comprises carbon black in an amount from 12 to 20% by weight of the composition. The invention is characterized by the improvement in which the carbon black comprises three carbon blacks, each having low structure and high resistivity. First and second ones of the carbon blacks are selected to impart the PTC effect. The third carbon black is selected to adjust the resistive properties of the composition into the range of commercial usage.

A composition embodying the present invention comprises a semiconductive composition that exhibits a PTC effect. The composition contains (a) a fluoropolymer having at least 20% crystallinity as determined by X-ray diffraction and (b) a particulate filler component which is dispersed in the polymer and which comprises carbon black in an amount from 12 to 20% by weight of the composition. The invention is characterized by the improvement in which the carbon black comprises three carbon blacks, each having low structure and high resistivity. First and second ones of the carbon blacks are selected to impart the PTC effect. The third carbon black is selected to adjust the resistive properties of the composition into the range of commercial usage.

DESCRIPTION OF PREFERRED EMBODIMENT

Figure 1:
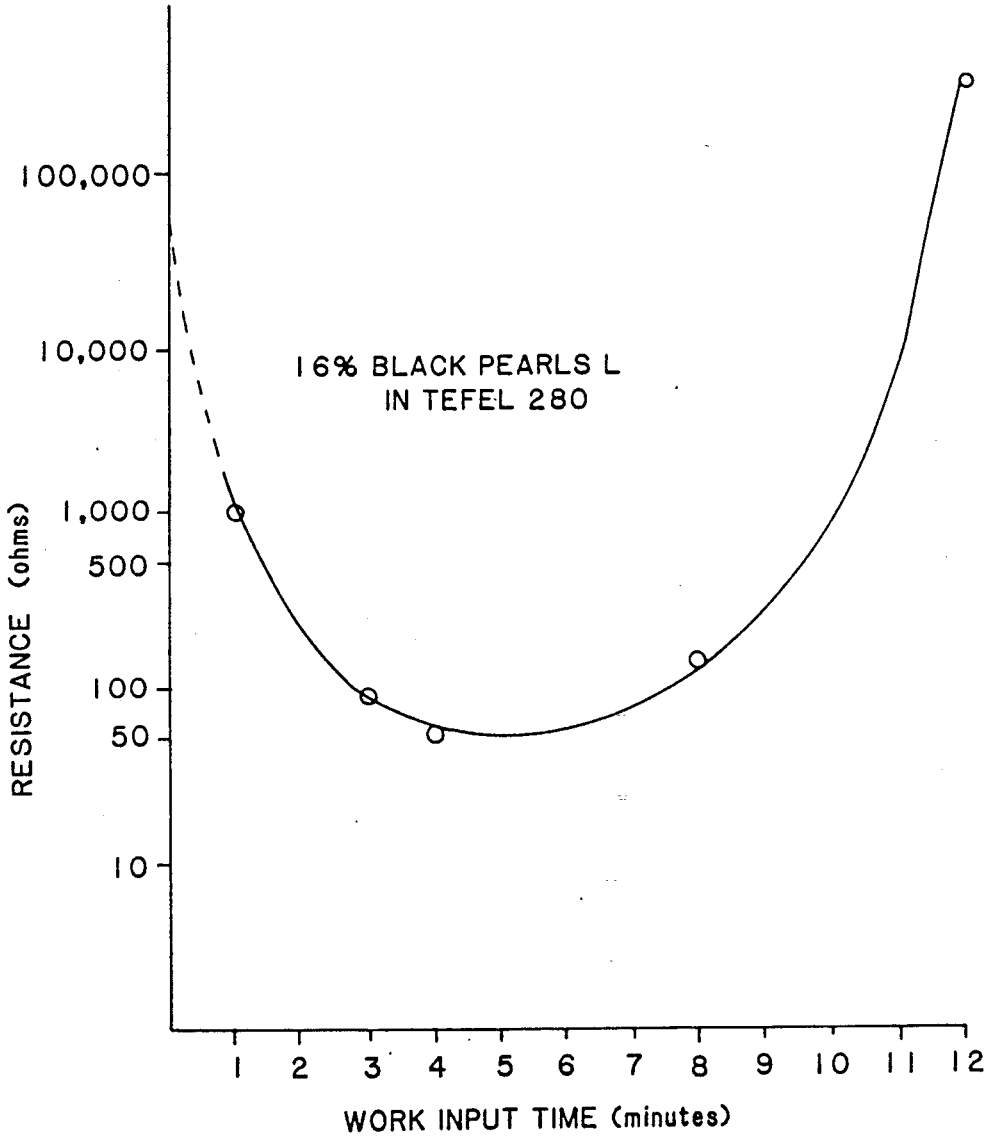
FIG. 1 is a graph of the log of plaque resistance versus work input time or mix time of a PTC composition sample.

For many years the industry has tolerated poor production yields for self-regulating heater articles intended for high temperature applications (e.g., 185° C. (150 psig steam) or so for process pipes subjected to steam cleaning). This has resulted in product returns, delayed deliveries and the like. I have invented an improved PTC device and PTC composition which can be produced with a reasonable yield. Significantly, PTC devices of my invention can be made with the process described in U.S. Pat. No. 4,327,480 which allows the production of a range of different heater articles (e.g., of different power outputs) by simple adjustments in the annealing conditions.

It is desirable to have a PTC composition that has resistance properties in the range of commercial usage that are reproducible within such range from one batch of mix to the next and that also have good uniformity within a given batch so that heater cable can be made with a uniform power output along its entire length. The resistance, and, hence, power rating, of heater articles produced with such compositions can be fine tuned to selected values (say 5, 8, 10, 15, or 20 watts per foot) by adjustments in the article fabricating process, as, for example, the annealing conditions.

The commercial usage range for self-regulating heater cables is determined by operating voltage and power ratings (generally 120 or 240 volts and 5,8,10,15 or 20 watts per foot). It is possible to determine whether a PTC composition has resistance properties in the range of commercial usage without actually fabricating the finished heater article. This is accomplished by fabricating a test plaque (approximate dimensions in inches of 5.5×2×2.5) in the manner described in U.S. Pat. No. 4,277,673 at column 4. I have found that a plaque resistance of 100–400 ohms for a PTC composition at four minutes mixing time will be within the range of commercial usage for self-regulating heater cable.

The improved PTC composition or core material of my invention is capable of self-regulating heater operation at both low and high temperature applications. The composition is formed with a crystalline fluoropolymer having a relatively high melting point (say 270° C.) and a blend of at least three carbon blacks. In order to achieve PTC effect, the degree of crystallinity must be at least 20% as determined by X-ray diffraction. The fluoropolymer may be, for example, polyvinylidene fluoride, ethylenechlorotrifluoroethylene, fluorinated ethylene propylene, ethylenetetrafluorethylene copolymer, or perfluoroalkoxy resin. The polymer selected will depend on the upper use temperature of the cable article.

The carbon black blend has three blacks, each being a low structured black as distinguished from a high structured black such as Cabot Corporation's Vulcan XC72 and each having high resistivity also as distinguished from Vulcan XC72. The first and second of the blacks are selected so as to impart PTC effect (i.e., a substantial anomaly, say a factor of six or more) to the composition, while the third black is selected to assure that the composition resistance is within the range of commercial usage uniformly from one batch of mix to the next as well as within a given batch.

In one class of designs embodying the invention, the three blacks can be selected from the carbon black products listed in Technical Report S-136 of Cabot Corporation. Low structured blacks having considerably higher resistance than Vulcan XC72 are classified in that report as Regular Color and Utility Grades. The first and second blacks, being selectable for their ability to impart PTC effect, are chosen from the Regular Color category.

In a preferred embodiment, which takes advantage of the short anneal process of U.S. Pat. No. 4,327,480, the first of these two blacks has a high volatile content, such as Mogul L (fluffy form) or Black Pearls L (pellet form). The volatile content for Mogul L is 5% and is achieved by an aftertreated processing step in which the black surface is chemically oxidized. The second of the blacks in the preferred embodiment is selected for both its PTC effect as well as heater article resistance in the commercial range. Preferably, the volatile content of this black is considerably less (by a factor of ½ and most preferably by 1/5) than that of the other PTC effect black. I have found that Regal 660 (volatile content of 1%) is suitable for the other of the PTC effect blacks.

The third black is selected to adjust the resistance of the composition or core material to be clearly within the range of commercial usage and to be uniformly so from one batch of mix to the next as well as within a given batch. With the first and second blacks selected in accordance with the above guidelines, I have found that the third black should be characterized by low structure, high resistivity and very low volatile content. The volatile content of the third black is considerably less than the volatility of the first black, by at least 1/3 and preferably by 1/10. An exemplary black meeting these guidelines is Monarch 120 listed in the Utility Grades category in the above mentioned Technical Report S-136.

The process for preparing PTC compositions is well known. The process employs a Banbury mixer, heated to a high enough temperature to assure that the polymer is molten. That temperature is about 315° C. for fluoropolymers. The dry carbon black is mixed with the molten polymer in the mixer until good dispersion and desired resistive properties are obtained.

FIG. 1 is a graph showing the resistance of a PTC composition comprised of 16% Black Pearls L by weight in ethylene/tetrafluoroethylene (namely Tefzel 280, available from E. I. DuPont de Nemours Company) on a semi-logarithmic scale as a function of work input (mixing time). This graph is a U-shaped curve. If the work input time is too short (1 minute or less) or too long (10 minutes or longer), the resistance is very high and considerably outside the range of commercial interest. The slope of the graph is rather steep between 100 and 400 ohms (both sides). Composition batches with these work input times (1.5 to 3 minutes or 7.to 9 minutes) have nonuniform resistance properties from one batch to the next as well as within a given batch itself. Another important factor is that work input time should be at least four minutes to obtain good dispersion of the carbon black in the polymer.

The FIG. 1 curve does have a fairly flat bottom portion in the work input time window from three to about seven and one-half minutes. This flat bottom portion falls in the lower region of the range of commercial interest. I have found that self regulating heater cables having uniform power output can be made with this composition at a work input time of about four minutes, but only for low resistance or high wattage articles, but not for high resistance low wattage articles. That is, its utility is severely limited.

Using the above mentioned process, some examples of preferred PTC compositions embodying the present invention were prepared. In each of these examples, the PTC composition comprises a 16% carbon black loading in Tefzel 280. In each example, the black blend constitutes Mogul L, Regal 660 and Monarch 120. In Table I, the black blend percentage proportions are listed for each example in the above order, thus, a 6-5-5 blend constitutes 6% Mogul L, 5% Regal 660 and 5% Monarch 120.

TABLE I

| PTC Compositions - Plaque Resistance (ohms) | | | | |
|---|---|---|---|---|
| Black Blend | Work Input (minutes) | | | |
| Examples | 1 | 4 | 8 | 12 |
| 1 (6-5-5) | 200 | 220 | 450 | 10,000 |
| 2 (6-7-3) | 75 | 100 | 240 | 1,700 |
| 3 (6-6-4) | 140 | 170 | 275 | 20,000 |

Figure 2:
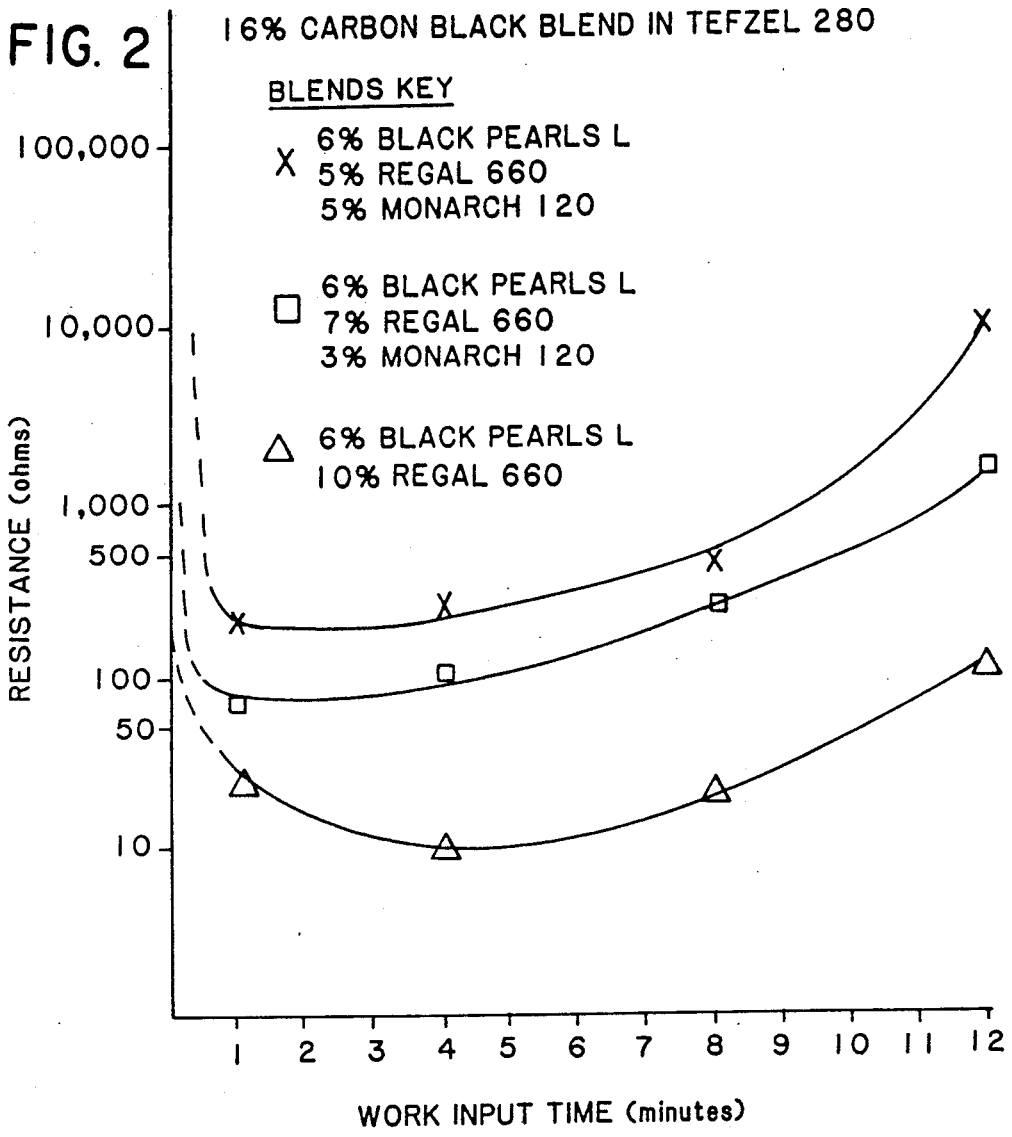
FIG. 2 is also a graph of the log of plaque resistance versus work input time of two exemplary PTC compositions in accordance with the present invention as well as of another sample of PTC composition.

All of the Table I examples are clearly Within the 100–400 ohm plaque resistance range at four minutes of mixing time and are uniformly so within a given batch as well as from one batch to the next of the mix. This is clear from FIG. 2 in which examples 1 and 2 have their plaque resistance plotted against work input time on the same scale as illustrated for FIG. 1. In FIG. 2 both the example 1 and example 2 curves have a relatively wide or flat bottom portion throughout the work input time window from one to eight minutes and these trough portions are within the plaque resistance range of 100 to 400 ohms at four minutes of mixing time. Uniformity or high production yields are assured for examples 1 and 2 which have relatively flat portions of the curve which are in the commercial range of interest and which extend substantially to either side of the four minute work input time.

For comparison purposes, a third curve is also shown in FIG. 2. This curve is for a Tefzel 280 based PTC composition with a carbon black blend of 6% Mogul L and 10% Regal 660. The trough portion of the work input curve for this PTC composition is clearly outside the range of commercial interest or usage.

Thermal uniformity is an important quality feature of a selfregulating heater cable. To determine thermal uniformity, temperature measurements are taken at various locations along the cable length with voltage applied to each end of the cable. An average temperature is calculated from these readings together with a standard deviation from the average temperature. A standard deviation in excess of 10 is generally unacceptable in quality.

Table II below tabulates the thermal uniformity of selfregulating heater cables (SRHC) in a Tefzel 280 host polymer for three different blends. Blend 1 (Black Pearls L and Vulcan XL72, 7.5% each) and Blend 2 (17% Black Pearls L) have standard deviations of 19.94 and 35.28 and are therefore unacceptable. Blend 3 constitutes Mogul L, Regal 660 and Monarch 120 in a 6-7-3 blend (corresponding to example 2 above) and has a standard deviation of 8.05 which is clearly acceptable in quality.

TABLE II

| Thermal Uniformity in SRHC Tefzel 280 Host Polymer | | | | |
|---|---|---|---|---|
| Blend (%) | Test Voltage (volts) | Cable Length (feet) | Avg. Temp. (°F.) | Standard Deviation (°F.) |
| (1) Black Pearls L (7.5)<br>Vulcan XC72 (7.5) | 120 | 237 | 213.75 | 19.94 |
| (2) Black Pearls L (17) | 240 | 362 | 185.3 | 35.28 |
| (3) Mogul L (6)<br>Regal 660 (7)<br>Monarch 120 (3) | 240 | 300 | 245.36 | 8.05 |

Figure 3:
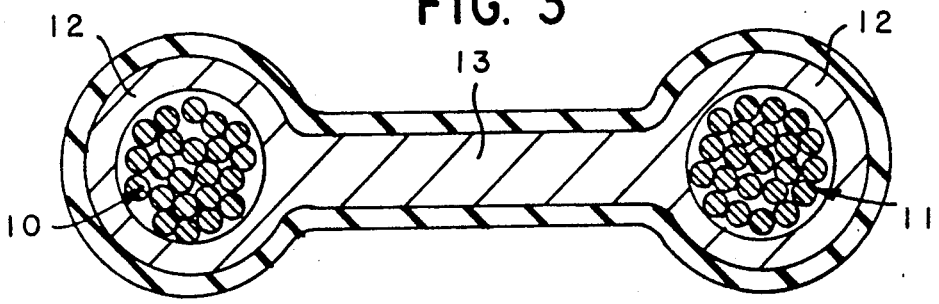
FIG. 3 is a cross-sectional view of a PTC effect self-regulating cable article of the invention.

In FIG. 3, the teachings of the present invention are shown incorporated into a self-limiting heating cable of indefinite length having a positive temperature co-efficient of resistance, substantially parallel stranded nickel coated copper wire 10, 11 appropriately cleaned, has extruded thereon (in accordance with standard extrusion techniques) the composition of this invention in an appropriate cross-section so as to embrace the conductors at the area 12 and provide a continuous interconnecting web 13. A suitable form-retaining and insulating jacket or covering is also extruded by conventional techniques over the full length of the heating cable. The FIG. 6 cross-section is illustrated as the conventional "dumbbell" shape. It will be appreciated by those skilled in the art that the cross-section need not be dumbbell in shape but could be of a rather uniform thickness across the width of the cable. That is, the web area 13 could be thicker than what is illustrated in FIG. 3.

From the foregoing, it is apparent that the present invention contemplates the use of carbon black blends comprising at least three low structured carbon blacks in a fluoropolymer to achieve novel and improved PTC compositions and/or heater articles intended for high temperature applications with reasonable production yields. Moreover, the preferred embodiments are exemplary, having been selected in accordance with the guidelines and teaching set forth above, and other examples can be selected from the aformentioned technical report S-136 of Cabot Corporation or from carbon black offerings of other suppliers.

As will be apparent to persons skilled in the art, various modifications, adaptations and variations of the foregoing specific disclosure can be made without departing from the teachings of the present invention.

What is claimed is:

1. An electrically conductive self-regulating heater article capable of operation at high temperatures, said article comprising at least two spaced elongated electrodes electrically interconnected by and embedded in a self-regulating semiconductive composition exhibiting a positive temperature coefficient of electrical resistance, said composition containing (a) a fluoropolymer having (i) at least 20% crystallinity as determined by X-ray diffraction and (ii) a melting point of at least 170° C. and (b) a particulate filler component which is dispersed in the polymer and which comprises carbon black in an amount from 12 to 20% by weight of the composition the improvement which comprises:

the carbon black comprising three carbon blacks, each characterized by low structure and high resistivity, first and second ones of the carbon blacks being selected to impart the positive temperature coefficient and the third carbon black being selected to adjust the resistive properties of the composition into the range of commercial usage.

2. An electrically conductive self-regulating heater article as set forth in claim 1 wherein the first carbon black has a relatively high volatile content and the second carbon black has a volatile content which is one-half or less than that of the first carbon black.

3. A self regulating heater article as set forth in claim 2 wherein the third carbon black has a volatile content that is less than one-third that of the first carbon black.

4. A self-regulating heater article as set forth in claim 1 wherein the percentage by weight proportion of the third carbon black is less than the combined percentage by weight proportions of the first and second carbon blacks.

5. A self-regulating heater article as set forth in claim 4 wherein the first carbon black has a relatively high volatile content and the second carbon black has a volatile content which is one-half or less than that of the first carbon black.

6. A self regulating heater article as set forth in claim 5 wherein the third carbon black has a volatile content that is less than one-third that of the first carbon black.

7. An electrically conductive self-regulating heater article in accordance with claim 6 wherein the percentage by weight of the first carbon black based upon the total mixture weight is at least 6%.

8. An electrically conductive self-limiting semiconductive composition exhibiting a positive temperature coefficient of electrical resistance, said composition containing (a) a fluoropolymer having (i) at least 20% crystallinity as determined by X-ray diffraction and (ii) a melting point of at least 170° C. and (b) a particulate filler component which is dispersed in the polymer and which comprises carbon black in an amount from 12 to 20% by weight of the composition the improvement which comprises:

the carbon black comprising three carbon blacks, each characterized by low structure and high resistivity, first and second ones of the carbon blacks being selected to impart the positive temperature coefficient and the third carbon black being selected to adjust the resistive properties of the composition into the range of commercial usage.

9. An electrically conductive self-regulating heater article as set forth in claim 8 wherein the first carbon black has a relatively high volatile content and the second carbon black has a volatile content which is one-half or less than that of the first carbon black.

10. A self regulating heater article as set forth in claim 9 wherein the third carbon black has a volatile content that is less than one-third that of the first carbon black.

11. A self-regulating heater article as set forth in claim 8 wherein the percentage by weight proportion of the third carbon black is less than the combined percentage by weight proportions of the first and second carbon blacks.

12. A self-regulating heater article as set forth in claim 11 wherein the first carbon black has a relatively high volatile content and the second carbon black has a volatile content which is one-half or less than that of the first carbon black.

13. A self regulating heater article as set forth in claim 12 wherein the third carbon black has a volatile content that is less than one-third that of the first carbon black.

14. An electrically conductive self-regulating heater article in accordance with claim 13 wherein the percentage by weight of the first carbon black based upon the total mixture weight is at least 6%.

* * * * *